United States Patent [19]

Crawford

[11] 4,261,664

[45] Apr. 14, 1981

[54] ONE-PIECE REPORT BINDER

[75] Inventor: Kenneth Z. Crawford, Crawfordsville, Ind.

[73] Assignee: Crawford Industries, Inc., Crawfordsville, Ind.

[21] Appl. No.: 925,110

[22] Filed: Jul. 17, 1978

[51] Int. Cl.[3] ..... B42F 3/00

[52] U.S. Cl. ..... 402/13; 402/21; 402/22; 402/77; 402/502

[58] Field of Search ..... 402/8, 13, 15, 17, 21, 402/22, 73, 77, 500, 501, 502

[56] References Cited

U.S. PATENT DOCUMENTS

| | | | |
|---|---|---|---|
| 1,829,613 | 10/1931 | Sato | 402/15 |
| 1,896,573 | 2/1933 | Buxton | 402/13 X |
| 2,133,069 | 11/1938 | Williamson | 402/15 |
| 2,139,843 | 12/1938 | Moore | 402/13 X |
| 2,329,786 | 9/1943 | Ringler | 402/13 |
| 2,445,671 | 7/1948 | Johnson | 402/75 |
| 2,468,355 | 4/1949 | Ambler | 402/15 |
| 2,559,556 | 7/1951 | Ambler | 402/15 |
| 2,575,583 | 11/1951 | Clarke et al. | 402/15 |
| 2,596,600 | 5/1952 | Rice | 402/15 |
| 2,773,504 | 12/1956 | McGervey | 402/8 |
| 2,911,977 | 11/1959 | French | 402/15 X |
| 3,238,948 | 3/1966 | Fiedler | 402/13 |
| 3,246,653 | 4/1966 | Sexton | 402/22 X |
| 3,362,411 | 1/1968 | Moller | 402/15 |
| 3,362,412 | 1/1968 | Moller | 402/15 |
| 3,516,755 | 6/1970 | Smith | 402/9 |
| 3,834,824 | 9/1974 | Jahn | 402/13 |
| 4,174,909 | 11/1979 | Jahn | 402/13 |

FOREIGN PATENT DOCUMENTS

| | | | |
|---|---|---|---|
| 725947 | 1/1966 | Canada | 402/19 |
| 1277810 | 9/1968 | Fed. Rep. of Germany | 402/21 |
| 1097272 | 1/1968 | United Kingdom | 402/13 |
| 1427335 | 3/1976 | United Kingdom | 402/13 |

*Primary Examiner*—Paul A. Bell

*Attorney, Agent, or Firm*—Jenkins, Coffey, Hyland, Badger & Conard

[57] ABSTRACT

A one-piece binder blank is die cut from plastic sheet stock and formed with integral straps and strap keepers to fasten loose leaves in the binder. The blank is scored to form one or more fold lines defining a spine between front and back covers. At spaced positions along the spine, the back cover is cut out to form a plurality of binder straps integrally connected at their bases with the cover and having barbed heads at their free ends. At corresponding opposite locations, the front cover is cut to form two spaced slits and the strips of material between the slits are stretched and displaced to form low arched keepers through which the barbed ends are passed to secure the straps to the front cover. The straps are longer than the distance between the strap bases and the keepers when the binder is open flat, and stand arched across the spine so as to allow loose leaves thereon to swing freely from flat against one cover to flat against the other. The straps are scored to form fold or hinge lines at their bases, at the necks of the barbed heads, and at an intermediate point to control their arched shape and their action when the binder is closed.

9 Claims, 8 Drawing Figures

ONE-PIECE REPORT BINDER

This invention relates to a loose-leaf binder and especially one adapted to hold a limited number of sheets, to fold flat when closed, and to open flat when opened and to allow the sheets to swing freely from flat against one cover to flat against the opposite cover.

There is a substantial need in the industry for an attractive, inexpensive binder for binding such things as corporate annual reports which contain a limited number of sheets and which on the one hand will fold flat when closed, and on the other hand, will open flat and allow the sheets to be swung from flat against one cover to flat against the other. Various attempts have been made in the past to provide such a cover but the results have not been fully satisfactory.

In accordance with the present invention, such a report binder is made from a one-piece binder blank, which may be die cut from plastic sheet stock, and the necessary sheet-retaining straps and strap keepers are formed from integral parts of that same binder blank. The blank and its elements may be cut, scored as necessary, and the binder completed in not more than two manufacturing steps. The one-piece binder comprises front and back covers interconnected at a spine defined by one or more fold lines in the blank. One of the covers at a plurality of positions spaced in the direction of the spine is cut to form from the stock of such cover a plurality of elongated narrow binder straps which are left integrally connected at their bases to the blank and which extend outward in a direction away from the spine. Each strap is formed with a generally triangular head connected at its base to the strap by a neck of reduced width so that the head forms rearwardly-presented barbs. The other cover, at positions opposite the straps, has pairs of slits cut therein, and the material between the slits is stretched and displaced from the plane of the cover to form arched keepers beneath which the heads of the straps may be passed to secure the ends of the straps in the keepers. The keepers are formed so that the barbs tend to retain the strap ends, but permit the straps to be released if desired. The straps are substantially longer than the distance along the blank from the base of each strap to the opposite keeper so that when the binder is open the straps stand arched across the spine to hold loose leaves and permits them to swing freely from flat against one cover to flat against the other.

The accompanying drawing illustrates the invention and shows a preferred embodiment representing the best mode presently contemplated by the inventor of carrying out his invention. In such drawing.

Figure 1:
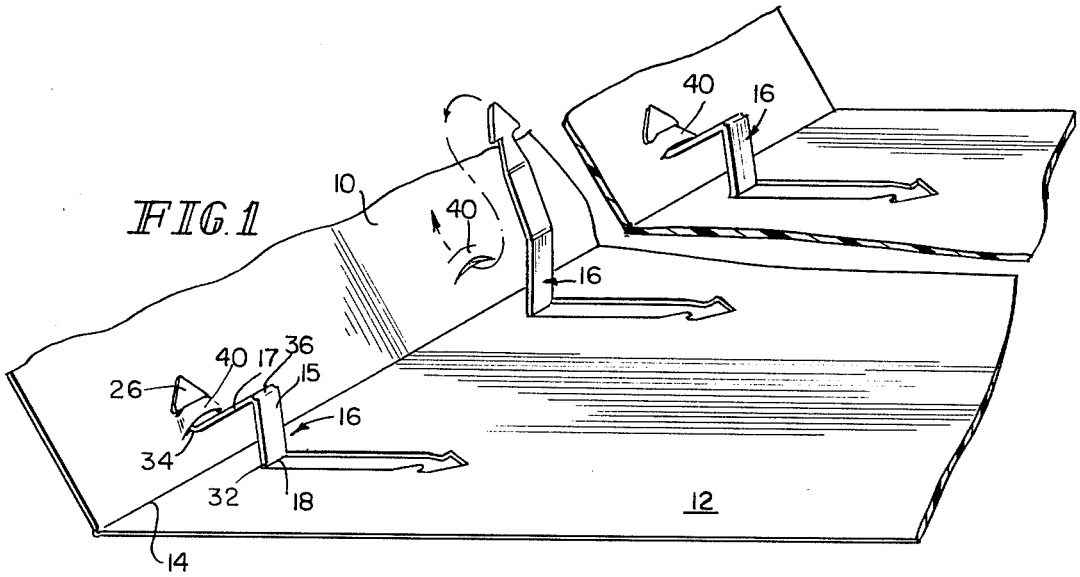
FIG. 1 is a perspective view of the central portion of a binder embodying the invention.
Figure 2:
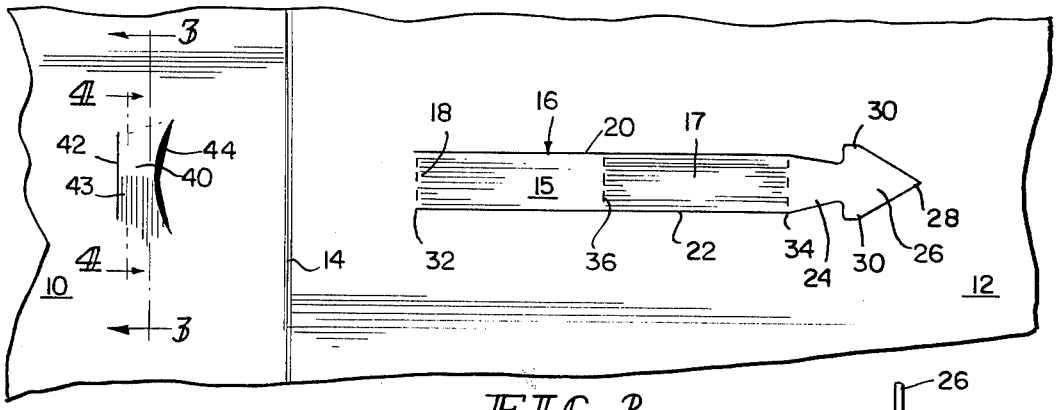
FIG. 2 is a partial plan view of the binder blank, showing the cuts and scores which are formed in the blank to define the spine and form the binder straps and keepers.

The binder shown in the drawing comprises a front cover 10 and a rear cover 12 integrally interconnected at a fold line 14 which defines the spine of the cover. The two covers are desirably formed by cutting a blank from plastic sheet stock, and the fold line 14 is formed by scoring the blank. At a plurality of positions spaced along the spine, the back cover 12 is cut out to form a plurality of binder straps 16 which are left integrally connected with the sheet stock at their bases 18, that is, at their ends closest to the spine, and those bases 18 are spaced a predetermined distance from the spine. As shown in FIG. 2, each binder strap 16 is cut from that cover 12 by a pair of spaced parallel slits 20 and 22, which extend from the base of the strap outward in a direction perpendicular to the spine fold line 14, to form two segments 15 and 17. The outer end of the segment 17 is connected by a tapered neck portion 24 to a triangular head 26. As shown, such triangular head 26 has a forward relatively sharp apex or point 28, and has at the base of the triangle two oppositely projecting corners or barbs 30 which project beyond the outwardly converging sides of the neck 24 and desirably also project beyond the sides of the main body of the strap 16. The strap is scored transversely with a bottom score line 32 at the base of the strap, a shoulder score line 36 at the base of the neck 24, and an intermediate score line 36 between the two segments 15 and 17 which are of equal length. In a representative embodiment, the blank was cut from plastic sheet stock about 0.020 inch thick and was $18\frac{1}{2}$ by $11\frac{3}{4}$ inches, the strap 16 was 3/16 inch wide, the head about a quarter inch wide at the base and about a quarter inch in height from the base to the apex 28, the two segments were each $\frac{5}{8}$ inch in length, and their bases were spaced 7/16 inch from the spine fold line 14. The $\frac{1}{4}$-inch wide heads will of course readily pass through standard $\frac{1}{4}$-inch punched openings in leaves bound in the binder and the $\frac{3}{8}$-inch wide straps will be loose in such openings to permit the leaves to turn freely thereon.

Figure 3:
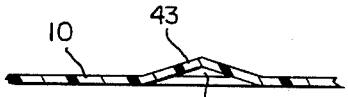
FIG. 3 is a section taken on the line 3—3 of FIG. 2 showing the finished form of a keeper.
Figure 4:
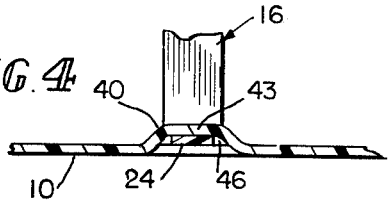
FIG. 4 is a section taken on the line 4—4 of FIG. 3, showing a keeper with a strap end inserted in the keeper.

The straps are intended to be bent upward from the plane of the back cover 12 (FIG. 5) and to have their ends secured to the front cover 10 (FIGS. 6 and 7) so as to form loops or straps to hold loose leaves in the binder. To form keepers for the free ends of the straps 16, the front cover is cut and formed to provide keepers 40 at positions on the front cover opposite the positions of the straps 16 on the back cover. Each such keeper 40 is formed by cutting a pair of slits 42 and 44 in the front cover. The outer slit 44 is desirably straight and slightly longer than the width of the head 26 of the strap. The inner slit 44 is desirably curved on an arc about a center between itself and the spine score line 14, and is somewhat longer than the outer slit 42. In the representative embodiment referred to, the outer slit 42 was 5/16 inch long and the inner slit 44 was $\frac{3}{8}$ inch long, and the two slits were $\frac{1}{8}$ inch apart. After the two slits have been cut, the strip of material 43 between the slits 42 and 44 is deformed and stretched upward to form an arched bridge as shown in FIG. 3, so as to define an opening 46 between itself and the plane of the cover 10. That opening is adapted to receive the point 28 of the head 26 of the strap 16 and allow that head to be pushed through between the arched bridge or strip 43 of the keeper and the material of the cover, to a self-retaining position. The longer length and arcuate form of the inner slit 44 causes the strip to define a wide entrance and a narrower exit for the passage through which the head is inserted. Since the base width between the barbs 30 of the head 26 is only slightly narrower than the full length of the outer slit 42, and since the stock of the cover 10 is of substantial thickness, the insertion of the head 26 through the slits 42 is required to distort the material adjacent the slit 42, and such material retracts after the head has passed through so as to engage behind the barbs 30 and releasably latch the head in the keeper 40. As shown in FIG. 3, the deformed and stretched strip of material 43 is desirably initially formed into an angular arch with a relatively sharp ridge at the top and with flat sides. As shown in FIG. 4, when a strap end has been inserted through a keeper 40, the strip 43 tends to be stretched to a flattened condition overlying the flat neck 24 of the strap.

The insertion of the head 26 and neck 24 of a strap through its keeper 40 leaves the two segments 15 and 17 of the strap standing in arched configuration between the base fold line 32 of the strap and the neck fold line 34. That fold line 34 lies closely adjacent the keeper 40, and the sharp bend at this point serves to stop the strap from sliding further through the keeper, while the barbs obstruct its retraction, so that the end of the strap is locked against removal from the keeper. To provide this arched configuration of the strap 16, the length of the combined strap segments 15 and 17 is related to, and substantially longer than, the distance along the surface of the covers 10 and 12 and the spine of the binder from the base of the strap to the keeper 40. In the representative embodiment referred to, two segments of the strap were each $\frac{5}{8}$ inch in length, so that the whole length of the strap between the scored fold lines 32 and 34 was $1\frac{1}{4}$ inches, while the base 18 and the keeper slit 44 were each 7/16 inch from the spine score line 14 so that the distance along the surface of the two covers 10 and 12 and the spine of the binder blank from the base 18 of the strap 16 to the slit 44 of the keeper 40 was $\frac{7}{8}$ inch.

Figure 5:
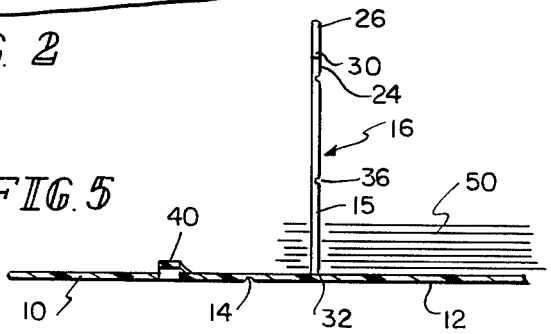
FIG. 5 is a somewhat diagrammatic and idealized view showing how leaves are placed on the strap.
Figure 6:
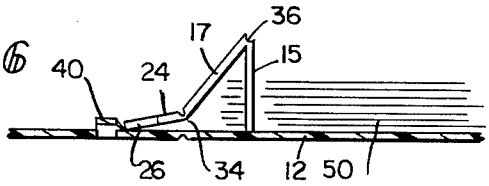
FIG. 6 is a similar view showing how the strap is inserted in the keeper.
Figure 7:
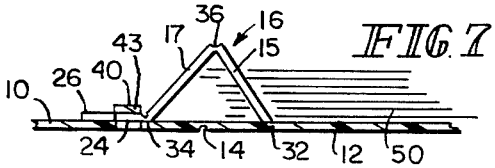
FIG. 7 is a similar view showing the strap in fully inserted position.

Use and operation of the one-piece binder is indicated in FIGS. 5-8. As shown in FIG. 5, the covers 10 and 12 will readily open to a position in which they lie substantially coplanar with each other and the spine defined by the fold line 14 so as to lie substantially flat against a supporting surface. The straps 16 are bent upward about the fold score lines 32 at their bases to upstanding positions, and a stack of loose leaves 50 are inserted over the straps 16 and laid against the back cover 12. Each strap 16 is then bent about its intermediate fold score line 36 to bring its head 26 into alignment with the opposite keeper 40, as shown in FIG. 6. The head and neck portion of the strap is bent about the fold score line 34 so that it lies flat against the face of the front cover 10, and the head end of the strap is then thrust beneath the arched bridge strip 43 of the keeper 40 to carry the head 26 through and past the keeper, as shown in FIG. 7. This moves the two equal segments 15 and 17 of the strap 16 to an equiangular position in which their lower ends are equally spaced from the spine fold score line 14 and they stand in a triangular arch above the plane of the covers. In this condition of the parts, the leaves 50 can be freely swung from flat against the back cover 12 to flat against the front cover 10 for easy and convenient reading.

Figure 8:
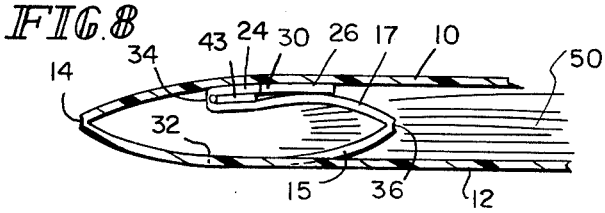
FIG. 8 is a somewhat diagrammatic view showing the positions of the covers and strap and leaves when the binder is closed.

When the binder is closed, as by swinging the front cover 10 over on top of the back cover 12, the arched straps 16 fold on themselves about the intermediate fold score line 36, and the two adjoining segments 15 and 16 of the strap move to a substantially overlying parallel relation, with the inner edges of the leaves 50 between them. The leaves 50 tend to move to the centers of the straps, and the covers 10 and 12 lie flat against the stack of leaves 50. As shown in FIG. 8, when the covers lie flat against the thin stack of leaves 50, the narrow spine defined by the fold line 14 lies substantially between the planes of the covers, and the interconnecting stock material adjacent the fold line 14 is bent to form a small dihedral angle at that fold line 14 sufficient to allow the covers to lie flat against the leaves as stated. In this folded condition of the binder, the lower segment 15 of the strap can move downward into the slot from which it was cut in the back cover 12, and while there is some build-up of thickness at localized areas where the keeper strip 43 lies between the neck 24 and the segment 17 of the strap, the overall effect is to provide a closed binder which is very little if any thicker than the thickness of leaves 50 and the covers 10 and 12. The binder thus closes to a relatively thin and compact closed position of uniform thickness over its whole area except only for a very slight thickening in the limited areas of the keepers 40. The binders are thus adapted to be stacked, handled, and mailed in thin flat condition; and when opened, provide for free and easy turning of the leaves 50 from flat against one cover to flat against the other.

The binder is preferably made of plastic sheet stock, such as polyethylene or polypropylene, which has the characteristic of forming long-lasting fold lines where the sheet stock is suitably scored, which lends itself to attractive decoration by silk screen printing, and which has a comfortable and attractive feel and appearance. The binders may be made by relatively simple and inexpensive manufacturing steps. The blanks need to be stamped from sheet stock, the straps 16 need to be cut from the back cover of the resulting blank, the slits 42 and 44 defining the keepers 40 need to be cut, the several fold score lines 14, 32, 34 and 36 need to be scored, and the strips 43 between the slits 42 and 44 need to be stretched and deformed as shown in FIG. 3 to form the keepers. These several steps can readily be completed in not more than two die stamping operations or in the two stages of a two-stage die, such as a simple steel-ruled die.

The binders are thus inexpensive and simple to manufacture, are easily filled with the desired stack of leaves 50, and when so filled form a thin and flat binder when closed and one which allows the leaves to be freely turned flat against one cover to flat against the other when the binder is open for use.

I claim:

1. A one-piece loose-leaf report binder, comprising a sheet stock blank forming front and back covers integrally connected by a narrow spine defined by one or more fold lines in the blank and including a primary fold line centrally between the covers which hingedly interconnects the covers for swinging movement thereabout between an open position in which they lie substantially coplanar with each other and said spine so as to lie flat against a supporting surface and a closed position in which the covers lie substantially in registry with each other and in parallel planes flat against the faces of a thin stack of leaves therebetween and the narrow spine lies substantially between such planes, one of said covers, at a plurality of positions spaced outward from the spine and spaced from each other in the direction of the spine, being cut to form from the stock of such cover a plurality of elongated narrow binder straps, such straps being left integrally connected to the cover at their inner ends at points spaced equal distances outward along the cover from said primary fold line, and extending outward therefrom, each strap being formed with a head connected to the strap with its rear corners projecting laterally to form rearwardly presented shoulders, the other cover having pairs of slits cut therein at positions opposite the inner ends of said straps and spaced outward along the cover from said primary fold line by distances substantially equal to the said spacing distance of the straps, the material between the slits forming keepers beneath which the heads of the straps are adapted to be passed to secure the free ends of the straps to such other cover, the straps being longer than the distance along the covers and across the spine from the integrally connected ends of the straps to the keepers so that when the binder is closed the ends of the straps lie substantially in closely spaced relation with each other in the parallel planes of the covers and when the binder is opened such ends move away from such other to widely spaced positions outward along the covers from the spine so that the straps stand arched from cover to cover across the spine to hold loose leaves and permit the same to swing freely from flat against one cover to flat against the other.

2. A one-piece binder as in claim 1 in which the material between the slits is stretched and displaced from the plane of the cover to form raised arches to pass the heads of the straps therebeneath, the inner slit of each pair is longer than the outer slit so that the arched keeper walls converge outward, the head of each strap is connected thereto by a neck portion narrower than the strap, the head having a width to pass freely into its arched keeper opening at the inner slit, the outer slit being not substantially shorter than such head width and the keeper material at such outer slit being displaced less than sufficient to form a clear opening for passage of the head therethrough, such material being distorted by such passage and thereafter retracting to engage about the neck of the strap and behind the head so as to latch the head in place.

3. A one-piece binder as in claim 1 or 2 in which the head of each strap is connected thereto by a neck portion of tapered width with its smaller end outward so as to increase the width of the adjacent rearwardly presented shoulders on the head.

4. A one-piece binder as in claim 1 in which the heads of the straps are connected thereto by neck portions narrower than the straps and the straps are formed with a base fold line where they are connected to the cover, and with an outer fold line substantially at the base of the neck and at the entrance to the keeper, so as to cause the straps to have sharp bends at these points and to arch therebetween, the bend at the keeper entrance being operative to hinder outward movement of strap ends in the keepers.

5. A one-piece binder as in claim 4 in which the straps are formed with a third fold line midway between said base and outer fold lines.

6. A one-piece report binder as in claim 1 in which the covers are connected by a spine formed by a single fold line centrally between the covers, the stock material of the covers, when the covers are in said closed position against a stack of leaves, being bent inward from the planes of the covers and forming a small dihedral angle at said fold line sufficient to allow the covers to lie flat against the leaves as aforesaid.

7. A one-piece binder as in claim 1 or 6 in which the head of each strap is connected thereto by a neck portion narrower than the strap, the head is of a width not greater than the width of the punched openings in leaves adapted to be received in the binder so that the head will pass freely therethrough, and the strap is of a width to fit loosely in such punched openings.

8. A one-piece loose-leaf report binder, comprising a sheet stock blank forming front and back covers integrally connected by a narrow spine defined by one or more fold lines in the blank and including a central primary fold line, the covers having an open position in which they lie substantially coplanar with each other and said spine so as to lie flat against a supporting surface and having a closed position in which the covers will lie in substantially parallel planes flat against the faces of a thin stack of leaves therebetween and the narrow spine lies between such planes, one of said covers, at a plurality of positions spaced outward from the spine and spaced from each other in the direction of the spine, being cut to form from the stock of such cover a plurality of elongated narrow bind straps, such straps being left integrally connected to the cover at their inner ends at points spaced equal distances outward along the cover from said primary fold line, and extending outward therefrom, each strap being formed with a head connected to the strap with its rear corners projecting laterally to form rearwardly presented shoulders, the other cover having pairs of slits cut therein at positions opposite the inner ends of said straps and spaced outward along the cover from said primary fold line by distances substantially equal to the said spacing distance of the straps, the material between the slits forming keepers beneath which the heads of the straps are adapted to be passed to secure the free ends of the straps to such other cover, the straps being longer than the distance along the covers and across the spine from the integrally connected ends of the straps to the keepers so that when the binder is open the straps stand arched across the spine to hold loose leaves and permit the same to swing freely from flat against one cover to flat against the other, the inner slit of each pair of keeper-forming slits being in the form of an arc about a center displaced toward the opposite strap to facilitate entry of the strap heads and being longer than the outer slit so that the keeper walls converge outward to facilitate outward passage of the strap heads and cause latching engagement of the shoulders of the heads as they pass through the keepers.

9. A one-piece binder as in claim 8 in which the head of each strap is connected thereto by a neck portion narrower than the strap.

* * * * *